US008279485B2

(12) United States Patent
Dirsch et al.

(10) Patent No.: US 8,279,485 B2
(45) Date of Patent: Oct. 2, 2012

(54) REGISTER REGULATION IN A PRINTING PRESS

(75) Inventors: Bernhard Dirsch, Erlangen (DE); Alexander Galle, Treuen (DE); Jörg Reh, Möhrendorf (DE)

(73) Assignee: Siemens Aktiengesellschaft, München (DE)

( * ) Notice: Subject to any disclaimer, the term of this patent is extended or adjusted under 35 U.S.C. 154(b) by 1074 days.

(21) Appl. No.: 12/084,711

(22) PCT Filed: Nov. 14, 2006

(86) PCT No.: PCT/EP2006/068450

§ 371 (c)(1),
(2), (4) Date: May 8, 2008

(87) PCT Pub. No.: WO2007/057392

PCT Pub. Date: May 24, 2007

(65) Prior Publication Data

US 2009/0141294 A1 Jun. 4, 2009

(30) Foreign Application Priority Data

Nov. 16, 2005 (DE) ..... 10 2005 054 975

(51) Int. Cl.
*H04N 1/60* (2006.01)
*G06F 3/12* (2006.01)

(52) U.S. Cl. ..... 358/1.9; 358/1.1

(58) Field of Classification Search ..... None
See application file for complete search history.

(56) References Cited

U.S. PATENT DOCUMENTS

| | | | | |
|---|---|---|---|---|
| 6,647,874 | B1 * | 11/2003 | Siegl et al. | 101/211 |
| 2002/0023560 | A1 * | 2/2002 | Siegl et al. | 101/248 |
| 2006/0207452 | A1 * | 9/2006 | Budach et al. | 101/349.1 |
| 2006/0272522 | A1 * | 12/2006 | Agne et al. | 101/180 |

FOREIGN PATENT DOCUMENTS

| | | | |
|---|---|---|---|
| DE | 32 25 164 | A1 | 4/1983 |
| DE | 20 2004 018 072 | U1 | 2/2005 |
| EP | 1 157 837 | A2 | 11/2001 |
| EP | 1 285 758 | A1 | 2/2003 |
| EP | 1 428 659 | A2 | 6/2004 |
| GB | 2 271 744 | A | 4/1994 |
| JP | 2003080679 | A | 3/2003 |
| JP | 2003237033 | A | 8/2003 |
| WO | WO 2004094146 | A1 | 11/2004 |
| WO | WO 2005/025872 | A1 | 3/2005 |

* cited by examiner

*Primary Examiner* — Dov Popovici

(57) ABSTRACT

There is described a regulating system for register adjustment in a printing press which has at least one printing unit, wherein the regulating system has at least one register regulator. In the regulating system, a pilot control variable and/or a register error estimated variable are/is provided for influencing the register adjustment. A drive bus is advantageously used for transferring these variables between different printing units, wherein the register regulation is advantageously distributed in a decentralized manner among different regulating devices for carrying out the drive regulation.

13 Claims, 5 Drawing Sheets

REGISTER REGULATION IN A PRINTING PRESS

CROSS REFERENCE TO RELATED APPLICATIONS

This application is the US National Stage of International Application No. PCT/EP2006/068450, filed Nov. 14, 2006 and claims the benefit thereof. The International Application claims the benefits of German application No. 10 2005 054 975.6 DE filed Nov. 16, 2005, both of the applications are incorporated by reference herein in their entirety.

FIELD OF INVENTION

The invention relates to register regulation of a printing press and to a corresponding method. A printing press is e.g. a web-fed rotary press, a flexographic printing press or similar. Printing presses of said kind comprise one or more printing units.

BACKGROUND OF INVENTION

In the case of a web-fed rotary press, the register-true coordination of a printing cylinder which prints on one side of a web takes place by means of register regulators. A register deviation which is picked up by a sensor, this being assigned to one web side, is supplied to one input of the register regulator. The register regulator is connected to a bus of a supervisory controller via a further input. The supervisory controller comprises a control station, section computers and service interfaces. The desired values for drive regulation of motors are specified by means of the supervisory controller. The unexamined German patent application DE 197 23 059 A1 indicates in particular that it is important that a color register does not deviate from a tolerance range. The speed of the color register regulation is particularly significant. The faster the register regulation, the more advantageous this is. In order to minimize error delays, it is proposed that a sensor be arranged immediately behind each printing position.

For the purpose of the register regulation, register marks are additionally printed on the web by printing cylinders, for example, and are picked up by means of a pair of sensors that are arranged behind the last print unit. The register marks that are printed on the web are picked up by the sensor and analyzed in a measuring head of the sensor. The ascertained register deviations of the printing cylinders are routed from an output of the sensor to a supervisory controller/regulator.

SUMMARY OF INVENTION

An object of the present invention is to achieve cost-effective and/or improved faster processing of signals relating to register regulation. Furthermore, it is also an object of the invention to achieve improved error correction.

This object is achieved by means of an apparatus as claimed in an independent claim and by means of a method as claimed in a further independent claim. The dependent claims relate to advantageous non-obvious embodiments of the invention.

As a result of the web tension, the register adjustment of one printing unit has a direct and immediate influence on the register compliance of the subsequent printing units in the web run. Consequently, a register adjustment in one printing unit cannot take place independently of the register adjustments of the other printing units. The influence is known in relation to speed, spacing and material properties.

According to the invention, when register adjustments are performed in one printing unit, the register compliance of subsequent printing units can be improved by utilizing the drive communication for the purpose of synchronized compensation movement. Register errors occur e.g. due to tension and strain fluctuations in the draw-in unit and unwinder as a result of splicing and irregular winding, and hence in the material which is transported in the machine. Tension and strain fluctuations occur in the machine due to non-driven rollers during acceleration and braking operations, for example, since these non-driven rollers must be accelerated and braked by the web. The consequential register errors are estimated e.g. with the aid of a model and supplied to the register regulator as pilot control.

The prior art only discloses supervisory register regulators which have a centralized structure, which regulate each register individually, and which can only respond slowly to register errors using +/−adjustment instructions.

In an embodiment of the invention, provision is made for implementing a register decoupling algorithm directly in the individual drives of a printing press or in the drives of the register rollers.

The drive communication is advantageously utilized in order to encompass the overall register decoupling network, for example.

The decoupling and relaying algorithms are executed e.g. in a decentralized manner in each individual drive which interacts with the paper web, and the synchronized drive communication which already exists for the synchronized individual drive mechanism is utilized for the purpose of synchronizing the register adjustments in the overall printing press or for influencing the decoupling. Similar algorithms can be utilized in printing presses having a longitudinal shaft and register rollers for register adjustment, in order to decouple the adjustment movement of one register roller from the register compliance of the subsequent printing positions. For this, e.g. the register rollers are equipped with drives that are synchronized with each other, and the decoupling network is realized with the aid of the these register roller drives and their drive communication.

Provision is advantageously made for implementing a register error estimator in the individual drives of a printing press. Relevant material variables are determined with the aid of the individual drives. For this purpose, material tensions, material speed, rotational speeds and rotational moments are measured and analyzed by the drives themselves. The measured variables are utilized e.g. as input values for the model in order to supply the pilot controls to the register regulators.

It is also advantageous to implement both aforementioned methods and the register regulator for an axis directly in the individual drives of a printing press:

By virtue of the register decoupling and register error pilot control, it is possible to achieve a very fast register regulation per printing position. Furthermore, by virtue of this method for register error estimation, it is possible to omit a measurement after each printing unit and hence to reduce the number of measurement positions, e.g. by measuring the register error after every 2nd, 3rd, 4th, etc. or only after the last printing unit and supplying the measured value to the relevant register regulators.

An advantage of the invention is the reduction in spoilage associated with register adjustments, said spoilage being necessary e.g. when setting up the machine (reduction in starting spoilage) or being present in the event of disruptions that are caused by a roll change or material change. The register decoupling advantageously effects a rapid, decentralized register regulation.

In a further embodiment, a pilot control variable and/or a register error estimated variable is provided for influencing the register adjustment in the regulation system, wherein a drive bus is utilized for transferring these variables between different printing units, wherein the register regulation is advantageously distributed in a decentralized manner among various regulating devices for the purpose of carrying out the drive regulation.

A printing press has e.g. at least one print unit, a drive unit which is assigned to the print unit, a regulating unit at least for regulating one drive unit, and a printing mark measuring device and/or a register measuring device. The printing mark measuring device or the register measuring device is directly connected via means for signal transfer to the regulating unit, which is provided at least for regulating one drive unit. The direct connection produces a shorter signal path and hence a reduction in the signal propagation time. It is thus possible to respond more quickly and effectively to discrepancies in the print format.

The register measuring device has e.g. a CCD camera or a scanner device. The register compliance of a printer can be determined from the optical signals that are picked up by the register measuring device. In the case of color printers, this involves color registers—also called passes—or a corresponding color register measuring device. A color register measuring device can be applied both to printing marks and to prints without printing marks using the print itself.

The printing press has a large number of printing units, for example, wherein these must rotate in a manner which is exactly synchronous and correctly oriented relative to each other in order to ensure a good print format. In order to control this, e.g. printing marks are applied to the paper that is to be printed. At least one printing mark measuring device—also called a feeler—is provided for analyzing these printing marks. With the aid of the printing mark measuring device, the difference between the individual printing units or colors is measured. Such a difference can also be determined by analyzing the print format using a (color) register measuring device and a corresponding analysis unit. In this context and in the following, alternatively or in combination, printing mark is also understood to signify a register mark. The printing mark measuring device is therefore understood to signify a register mark measuring device which is used as an alternative to or in combination with the printing mark measuring device. The register mark measuring device is provided for the purpose of recognizing the register marks. When using the improved printing mark measuring device or register mark measuring device, a high-resolution image analysis device is particularly advantageous in this case. The measurement of the difference serves to determine at least one correction value for e.g. a circumferential register of the printing unit(s) or color(s) that are situated outside of the tolerance. These correction values are time-critical and the precise management of these correction values is very important for the quality of the print format. The printing mark measuring device or the register measuring device is directly linked to a regulating unit for drive regulation of a drive of the printing press. A means for signal transfer such as e.g. a cable transfer or even a radio transfer can be utilized for the link. Such a direct injection results in faster processing of the correction value, which is calculated e.g. in the regulating unit, and consequently in better quality of the print format.

By contrast, the unexamined German patent application DE 197 23 059 A1 provides for the signal of the sensor to be transferred to an assigned register regulator, wherein the register regulator is connected to a bus including a supervisory controller and a correction value for improving the register compliance can be supplied to a drive regulator via the control station, corrected as a desired value of the supervisory controller.

This long chain of communication partners is now shortened according to the invention, in that the printing mark measuring device is directly connected to the regulating unit, which is provided at least for regulating one drive unit, by a means of signal transfer.

In an advantageous embodiment of the invention, the printing mark measuring device analyzes the measurement signal of the printing mark measuring device or of the register measuring device in an analysis unit. The analysis unit of the printing mark measuring device has a direct data link, e.g. a serial link, to the regulating unit, i.e. a drive regulator of the printing unit. Software which analyzes the measured values of the printing mark measuring device and calculates the correction values or even directly implements the correction can run in the regulating unit.

As a result of the direct coupling and hence faster processing of the correction values, a qualitative improvement of the print format is produced. Moreover, as a result of the omission of a previously necessary separate correction computer, a cost optimization is produced. The correction signal or correction signals are sent to the regulating unit at a control station e.g. also via an existing communication connection within a printing press.

The printing mark measuring device, which has an analysis unit, the analysis unit converting the signals that are generated by a printing mark measuring device into e.g. digital signals, sends these digital signals e.g. via a bus system to the regulating unit. A bus system which is already in use in the printing press can advantageously be utilized as a means for signal transfer. A corresponding approach applies in the case of a register measuring device.

In a further advantageous embodiment, the regulating unit has the integrated analysis unit which converts the signal that is generated by the printing mark measuring device or the register measuring device, e.g. an analog signal, into a digital signal that can be processed by the regulating unit.

In a further advantageous embodiment, the regulating unit, which is provided at least for regulating one drive unit and is directly connected to the printing mark measuring device or the register measuring device, has a master functionality relative to further drive units or relative to further regulating units. In this case, a drive unit has at least one electric motor and one static converter.

In one embodiment, the regulating unit for regulating a drive unit of a printing press has a signal interface for the input of a signal from a printing mark measuring device or the register measuring device.

In a method for operating a printing press, the printing mark measuring device transmits a printing mark signal or the register measuring device transmits a register measurement signal to the regulating unit. The regulating unit calculates a correction value for the movement regulation of at least one drive unit.

BRIEF DESCRIPTION OF THE DRAWINGS

Exemplary embodiments of the invention are illustrated in the drawing and are explained in greater detail below, wherein.

DETAILED DESCRIPTION OF INVENTION

For the purpose of explaining the figures, reference is made to the claims.

Figure 1:
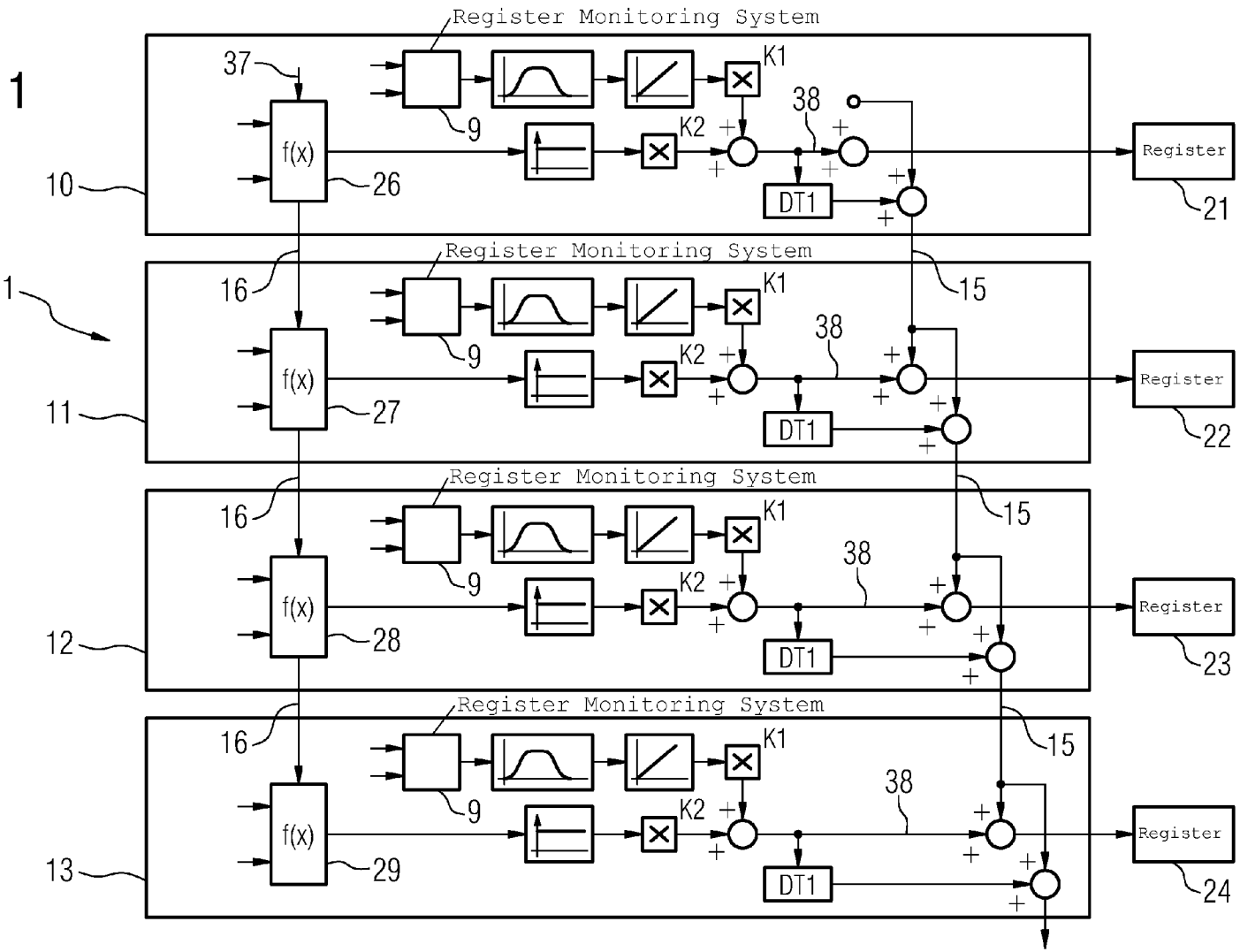
FIG. 1 shows a decentralized register regulation.

The illustration according to FIG. 1 shows a register decoupling with a register error estimation in the case of a printing press having four print units, wherein the four print units are assigned the register regulators 10, 11, 12 and 13 respectively. The register regulator 10 has a model 26. Input variables that are entered into this print model comprise print parameters 37 and, in addition, the drive speed and a register error which was detected by means of a register error measurement system. These two input signals are indicated by means of arrows. An estimated register error is determined by means of the model 26. This is shown by an arrow emerging from the model 26. A value which represents a material elongation of the printing material is provided as a further input for the model 26. As a further input variable, the register regulator 10 also uses a correction signal from a register monitoring system 9. The incoming signals are processed according to the illustration in FIG. 1. An output signal of the register regulator 10 is the value for register compensation. This value for register compensation is transmitted to the register 21. In addition to a first print unit, the printing press also has further print units to which corresponding register regulators are assigned. The first print unit has register regulator 10, the second print unit has register regulator 11, etc. Data is passed between the register regulators 10 to 13. This relates to both the register error estimated variable 16 and a pilot control variable 15. This pilot control variable 15 corresponds to the decoupling signal 38 and is therefore used for the decoupling. The register regulators 11 to 13 are constructed in a manner which corresponds to the register regulator 10. However, the register regulators 11, 12 and 13 differ from the register regulator 10 in that the pilot control variable 15 is added to the value of the register compensation, this value being subsequently transmitted to the register 22, 23 or 24.

Figure 2:
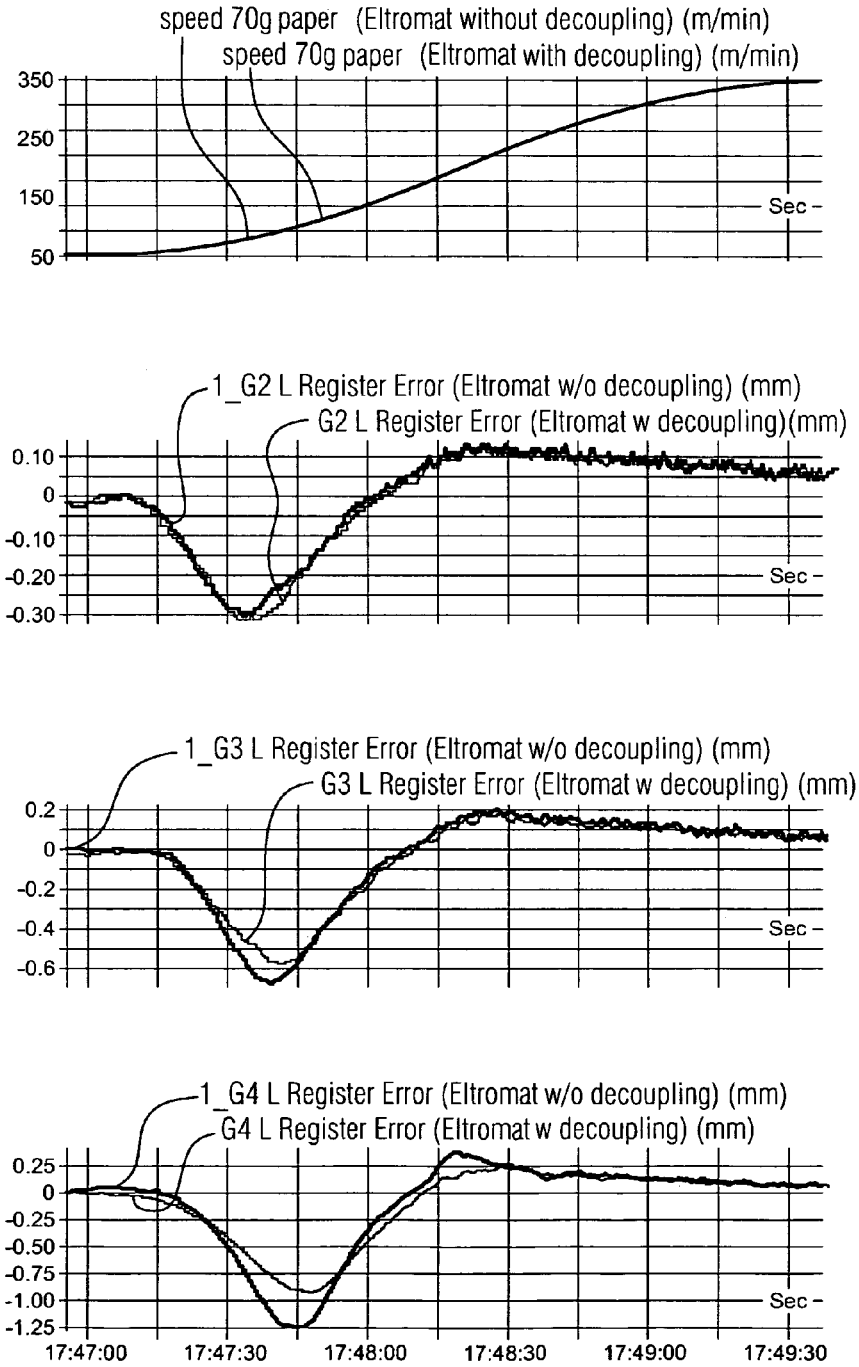
FIG. 2 shows measured variables in the case of register regulation.

The illustration according to FIG. 2 shows the improvement in the register regulation as a result of decoupling, with reference to the example of a machine startup. The effect of the decoupling increases with the number of printing units and web length. This means that the positive effect of the invention is more noticeable in the case of a large number of printing units and a long printing press. The illustration according to FIG. 2 shows the speed with and without decoupling in the first diagram, wherein the register errors at various subsequent printing units are shown in each case in the subsequent diagrams. It is evident from the illustration that the error increases with the increasing number of printing units, wherein the error can be significantly reduced by means of the inventive decoupling and the register error estimator. This is shown particularly clearly in the case of the printing unit G4. In this case, the printing units G2 and G3 are located before the printing unit G4 with regard to the direction of movement of a printing material.

Figure 3:
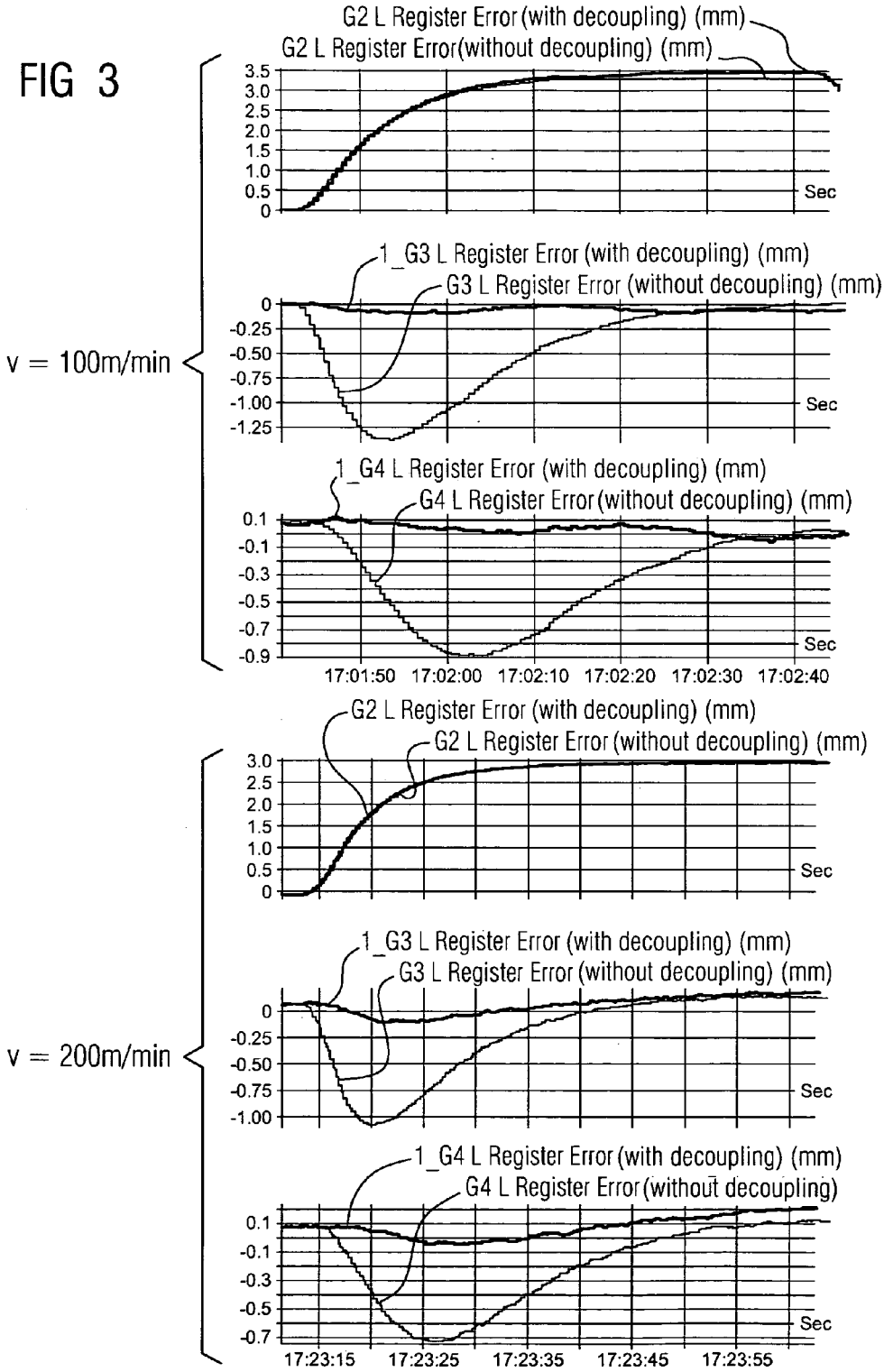
FIG. 3 shows further measured variables in the case of register regulation

The illustration according to FIG. 3 shows a manual adjustment of the register of a printing unit. In this case, the register errors for the various printing units (G2, G3 and G4) are shown again in the diagrams. Furthermore, FIG. 3 shows that the register error also depends on the web speed of the printing material, wherein the units are shown in relation to the web speed of 100 m/min and 200 m/min.

Figure 4:
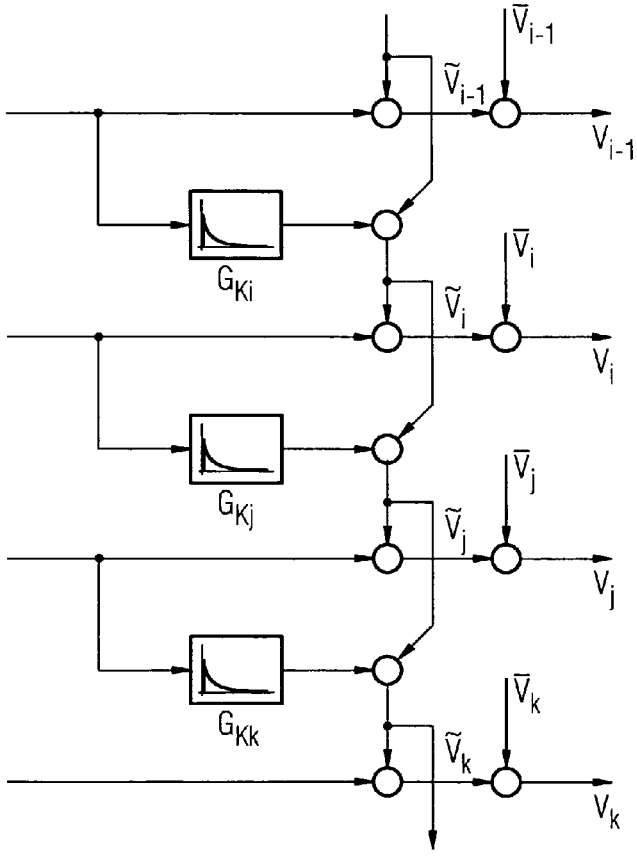
FIG. 4 shows a diagram relating to a method for decoupling the registers.

The illustration according to FIG. 4 shows a register decoupling network in a schematic illustration which broadly corresponds to the illustration according to FIG. 1 and again describes the underlying functionality of the invention. It can be seen from FIG. 4 that, in the case of the present invention, it is particularly significant that register error estimated variables of a preceding regulator are passed to the various regulators, wherein a pilot control variable is also transferred in addition to this register error estimated variable. Of course, further pilot control variables, which must be adapted to the relevant printing press, can also be used in the various regulators.

Figure 5:
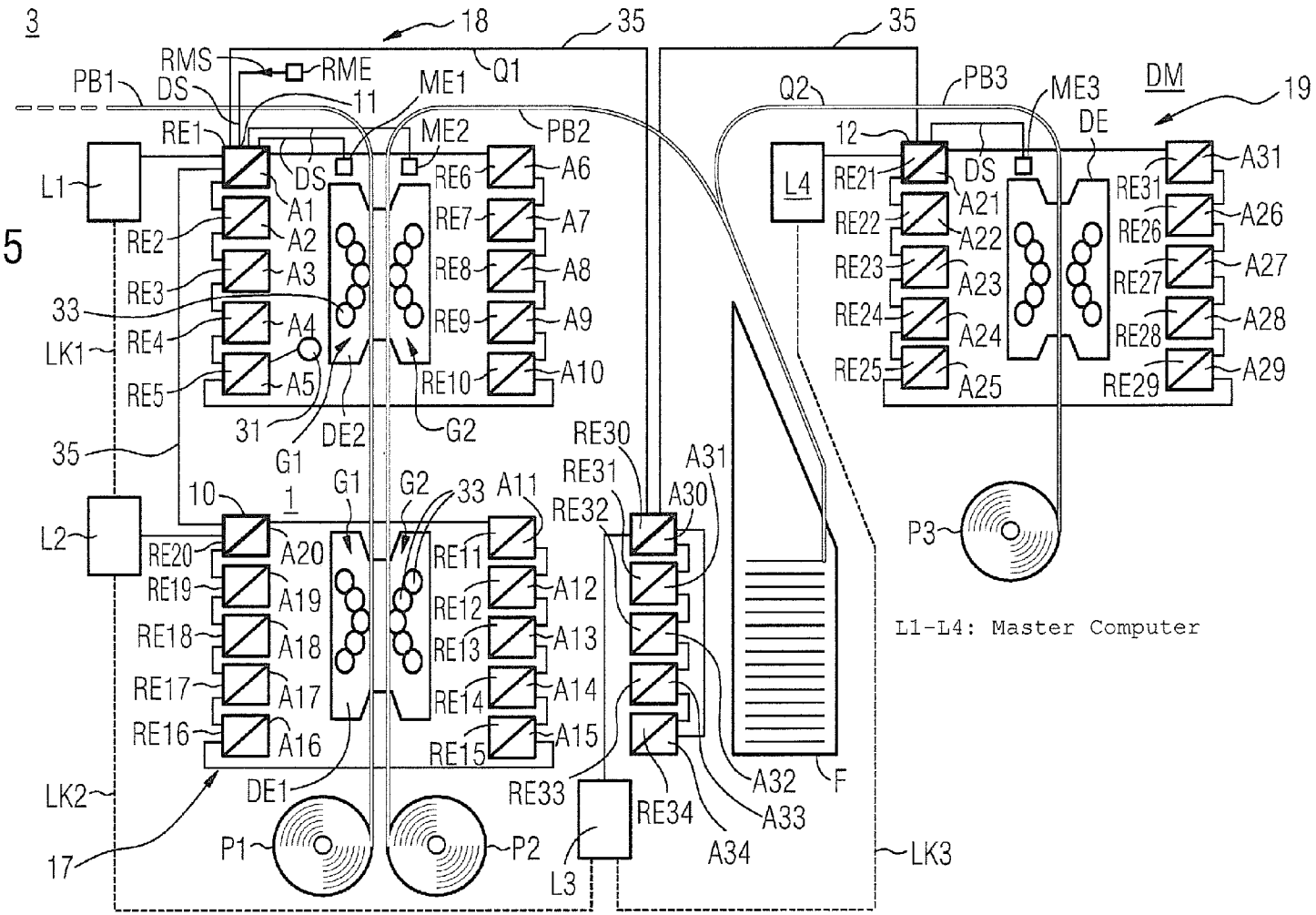
FIG. 5 shows a printing press.

In the illustration according to FIG. 5, the structure of a printing press DM, 3 is shown in the form of a schematic representation. The printing press 3 has printing units 17, 18 and 19. A regulating system 1 is established by means of register regulators 10, 11, 12. The regulating system 1 also has a data bus 35. Paper webs PB1 to PB3 run from paper rolls P1 to P3 through print units DE, DE1 and DE2 to a folding device F. The paper web PB1, after passing through the print units DE1 and DE2, is carried to other processing units (which are not shown in the illustration according to FIG. 1, however). The paper web PB1 therefore tails off with a broken line in the drawing.

The print units DE, DE1 and DE2 are represented by means of an approximately H-form external contour. The print units DE, DE1 and DE2 comprise in each case ten cylinders ZY which are arranged into two groups G1, G2 of five cylinders ZY each. All cylinders or wheel-form machine elements of a print unit DE, DE1, DE2 and of a folding device F are designated as cylinders ZY here. The paper webs PB1 to PB3 run via these groups G1, G2, which are designated as printing positions in the print units DE. A printing position consists essentially of e.g. a blanket cylinder, a plate cylinder and an inking and damping unit. Each printing position allows a color to be printed on one side. All printing positions which work in conjunction with a folding device F, i.e. all printing positions in which the printed paper webs PB1 to PB3 are transported to a folding device F, belong to a rotation. In this case, the print units DE, DE1, DE2 are usually housed in printing towers.

Each individual driven cylinder has a drive device A1 to A29. An electric machine 31 is assigned to the drive devices A1 to A29, wherein only one electric machine 31 for driving one roller 33 is illustrated in the FIG. 5 for reasons of space. A regulating unit RE1 to RE29 is assigned to the drive device A1 to A29. Depending on the level of integration in the drive units, the drive unit has e.g. a motor and a static converter. In the case of a higher level of integration, the drive unit has an integrated regulating unit RE1 to RE29. Drive units A30 to A34 and associated regulating units RE30 to RE34 are also provided for the folding device F. The print units DE, DE1 and DE2 and the folding device F have a regulating device RE1, RE20, RE21 and RE30 with master functionality for each drive group including the drive units. The regulating devices RE1 to RE10 of a drive group are networked together for data communication purposes. The regulating units RE1, RE20, RE21 and RE33 and the drive units A1, A20, A21 and A30 which have a control or master functionality are characterized by a thicker outline in the drawing.

An associated master computer L1 to L4 is assigned to a group of drive units or regulating units and has a data connection to these. The master computers L1 to L4 are also connected together by means of a master computer communication LK1 to LK3. This is represented in the drawing by means of a broken line. Further embodiments and data networks are also possible here.

A master computer L1 to L4 is responsible for supervisory process organization. A printing mark measuring device ME1, ME2 and ME3 which is used for picking up printing marks on the paper webs PB1, PB2 and PB3 is arranged at the end of the print units DE and DE2. The printing mark measuring device ME1, ME2 and ME3 is connected to a regulating device RE1 or RE21. The regulating device RE1 or RE21 determines the correction value for the drive or drives of the drive units in order to improve the print format. Consequently, the previously required procedure in which the correction value was calculated by means of a separate electronic analysis system and output to the relevant drive units of the printing units, e.g. via a pulse-width modulated binary signal, is superseded. A previously required long path for the transfer of the correction values to a master computer of the printing press, e.g. via a serial link, via Profibus® or Arcnet, is no longer necessary.

As a result of connecting the printing mark measuring device ME1, ME2, ME3 directly to the regulating unit RE1, RE21 or the drive regulator of the printing unit, e.g. via a serial link (DS), the signal path is considerably shortened, this being advantageous in terms of the faster analysis of the signals or the correction. As a result of the direct injection and hence faster processing of these correction values, a quality improvement of the print format is produced. As a result of omitting a separate correction computer, cost optimization is also achieved. The correction signals can be transmitted from the regulating device to a master computer or a control station via existing communication connections.

For the paper web PB1, as an alternative to or in combination with the printing mark measuring device ME1, provision is made for a register measuring device RME which has a data connection to the regulating unit RE1. A register measurement signal RMS, which is represented as an arrow in the FIG. 1, is then used to correct the printing.

The invention claimed is:

1. A regulating system for a register adjustment in a printing press which has at least one printing unit, comprising:
- a first printing unit with a first register regulator for a first register; and
- a second printing unit with a second register regulator for a second register,
- and
- at least one variable to influence register adjustments of the first and second registers, wherein the variable is a pilot control variable, and/or a register error estimated variable,
- wherein the register adjustments of the first and second registers are linked to each other such that data is transmitted between the first and second register regulators relating to both the register error estimated variable and the pilot control variable, and wherein the pilot control variable of the first register regulator is added to a register adjustment of the second register regulator.

2. The regulating system as claimed in claim 1, wherein a model generates the register error estimated variable.

3. The regulating system as claimed in claim 2, wherein the model is integrated in a regulating device for regulating an electric motor, wherein the electric motor drives a roller of the printing press.

4. The regulating system as claimed in claim 3, wherein the regulating system has a drive bus.

5. The regulating system as claimed in claim 1, further comprising a register measuring device, wherein
- a first input signal of the first or second register regulator depends on a measurement signal of the register measuring device, and
- a second input signal of the first or second register regulator depends on the pilot control variable.

6. The regulating system as claimed in claim 5, wherein the printing press has only one register measuring device for the first or second register, wherein the first or second register is a longitudinal register or a lateral register.

7. The regulating system as claimed in claim 3, further comprising a register measuring device, wherein
- a first input signal of the first or second register regulator depends on a measurement signal of the register measuring device, and
- a second input signal of the first or second register regulator depends on the pilot control variable.

8. A method for register adjustment in a printing press, comprising:
- providing a first printing unit with a first register regulator for a first register; and
- providing a second printing unit with a second register regulator for a second register,
- utilizing register adjustments of the first and second printing units based upon a pilot control variable or a register error estimated variable, if a print parameter changes,
- wherein the register adjustments of the first and second registers is linked to each other such that data is transmitted between the first and second register regulators relating to both the register error estimated variable and the pilot control variable, and wherein the pilot control variable of the first register regulator is added to a register adjustment of the second register regulator.

9. The method as claimed in claim 8, further comprising:
- providing a regulating device for a regulation of an electric machine, wherein the regulation of the register adjustment is carried out in the regulating device for the regulation of the electric machine.

10. The method as claimed in claim 9, further comprising:
- providing a data bus;
- transmitting the pilot control variable or the register error estimated variable via the data bus;
- transmitting a rotational speed variable or position variable via the data bus; and
- using the speed variable or the position variable in a speed regulation or a position regulation of the electric machine.

11. The method as claimed in claim 10, wherein the pilot control variable and/or the register error estimated variable is transmitted from the first register regulator via the data bus to the second register regulator, wherein the first and second register regulators are synchronized via the data bus, wherein the rotational speed variable or the position variable are also transmitted via the data bus.

12. A printing press, comprising:
- a first printing unit with a first register regulator for a first register,
- a second printing unit with a second register regulator for a second register,
- at least one variable to influence register adjustments of the first and second registers, wherein the variable is a pilot control variable and/or a register error estimated variable,
- wherein the register adjustments of the first and second registers is linked to each other such that data is transmitted between the first and second register regulators relating to both the register error estimated variable and the pilot control variable, and wherein the pilot control variable of the first register regulator is added to a register adjustment of the second register regulator.

13. The printing press as claimed in claim 12, wherein a model generates the register error estimated variable, wherein the model is integrated in a regulating device for regulating an electric motor, wherein the electric motor drives a roller of the printing press, and wherein the printing press has a single data bus, wherein the data bus transmits the pilot control variable and/or the register error estimated variable for register regulation and a rotational speed variable and/or a position variable for rotational speed regulation and/or position regulation of an electric machine.

* * * * *